United States Patent [19]

Burns

[11] 4,136,996

[45] Jan. 30, 1979

[54] DIRECTIONAL DRILLING MARINE STRUCTURE

[75] Inventor: Robert B. Burns, Huntington, N.Y.

[73] Assignee: Texaco Development Corporation, New York, N.Y.

[21] Appl. No.: 799,633

[22] Filed: May 23, 1977

[51] Int. Cl.[2] ..... E21B 7/12; E21B 7/04; E21B 15/02

[52] U.S. Cl. ..... 405/195; 175/5; 175/8

[58] Field of Search ..... 61/89, 88, 87, 86; 175/5, 9, 6-8, 10

[56] References Cited

U.S. PATENT DOCUMENTS

| | | | |
|---|---|---|---|
| 1,094,949 | 4/1914 | Taft | 175/9 X |
| 2,740,261 | 3/1956 | Stark | 61/89 |
| 2,924,947 | 2/1960 | Peterson | 175/8 X |
| 3,029,608 | 4/1962 | Perkins | 61/89 |
| 3,474,630 | 10/1969 | Pogonowski | 175/9 X |
| 3,657,895 | 4/1972 | Phelps | 175/9 X |
| 3,685,300 | 8/1972 | Mott et al. | 175/9 X |
| 4,030,310 | 6/1977 | Schirtzinger | 175/8 X |

*Primary Examiner*—Dennis L. Taylor
*Attorney, Agent, or Firm*—Thomas H. Whaley; Carl G. Ries; Robert B. Burns

[57] ABSTRACT

Marine structure adapted to be fixed to the ocean floor for drilling wellbores into the latter. A drill conductor cage is removably positioned within the marine structure at a submerged position. The cage holds one or more drill string guides in a manner that directionally oriented wells can be drilled without movement of the structure. The cage is readily disengaged from its under-water working position in order that it can be brought to the water's surface, or otherwise adjusted to facilitate the addition of further conductor guides.

9 Claims, 6 Drawing Figures

FIG. 2
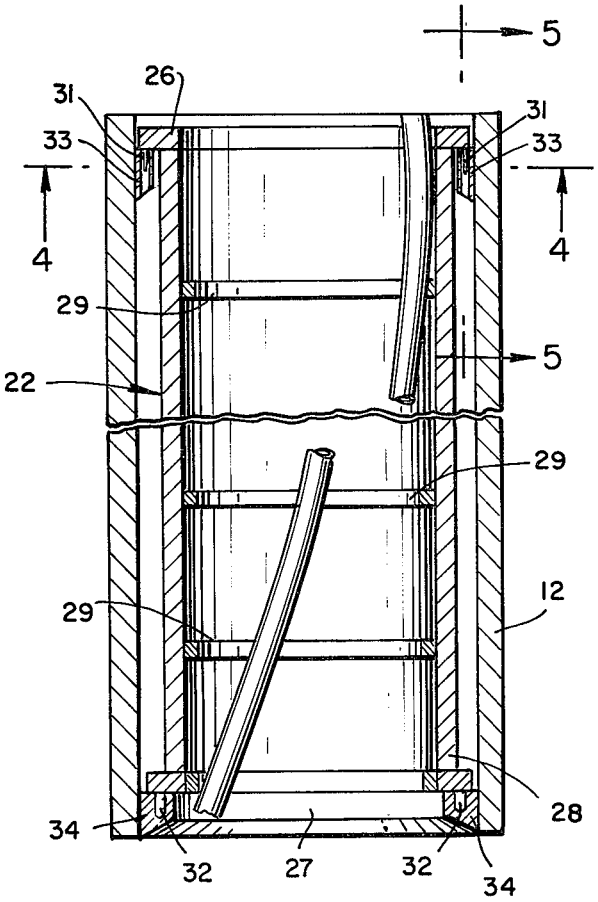
FIG. 5
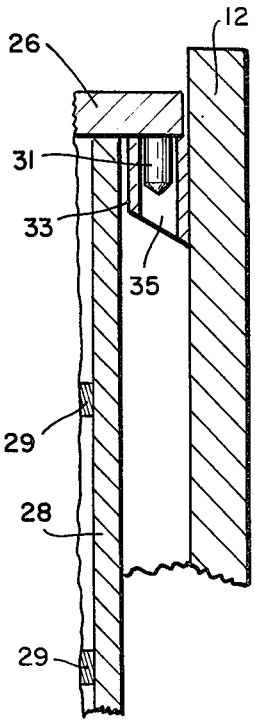
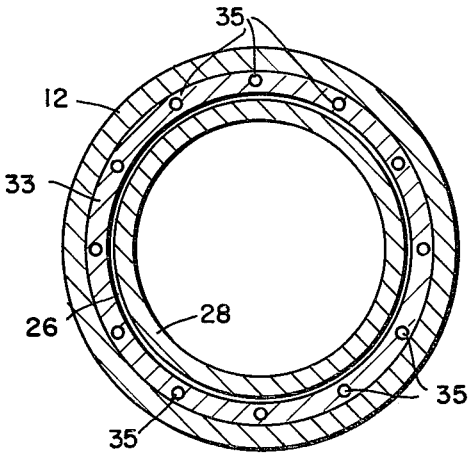
FIG. 4

DIRECTIONAL DRILLING MARINE STRUCTURE

BACKGROUND OF THE INVENTION

In the drilling of offshore petroleum or gas producing wells from a fixed platform it is customary to insert a conductor member into the marine structure between the work deck and the well head. This conductor serves the primary purpose of enclosing the rotating drill string. Thus, drilling mud can be circulated through the drill string and returned to the deck.

In some instances where the petroleum bearing reservoir is determined to be relatively close to the surface of the water, it is necessary to offset the rotating drill string rather quickly so it will assume a desired direction whereby to enter the reservoir. In shallow areas this offsetting of the drill string from vertical must be accomplished as soon as possible so that the drill will intersect the reservoir within a short period of time.

It is known that by initially deflecting the drill string such that it enters the ocean floor at a desired angle, the operation is expedited. In one method of achieving such directional drilling a conductor is positioned within the offshore structure and aligned at an angle to the structure floor. Thus, the drill string by being guided through the conductor will enter the floor at a predetermined angle and direction.

It is also known that to effectuate the desired offset, the drill string can be initially forced from a vertical disposition into the desired angle. This is normally done through use of an elongated conductor guide which is carried within the body of the marine platform. The guide comprises a heavy walled tube-like member which is preformed into a desired curved configuration. Addition of curved or straight guide members to the marine structure after it has been placed at an offshore site is usually an expensive operation requiring the use of several divers.

The instant invention provides a novel arrangement in an offshore structure which serves the purposes of facilitating the drilling operation. It further serves to reduce the overall operating expenses and provides the structure with a greater degree of versatility due to the greater number of wells that can be drilled from a single position.

The marine structure is thus provided not only with ordinary drilling equipment such as derrick, rotary table and the like, but also with an elongated cage or substructure which serves to support a number of conductor guides. The cage can be detached from its normal submerged position in the marine structure and raised to the working deck or adjacent to the latter. Thereafter, the number of, or the pattern of conductor guides, can be changed by addition to or removal of said guides to achieve a desired drilling pattern at the ocean floor. Further, the cage can be realigned with respect to the structure prior to being reinserted into its seating or working position. Thus, the original conductor guides or the newly inserted guides can be disposed to permit further drilling in a particular direction from an initially upright disposition.

It is therefore an object to provide a marine structure capable of drilling wellbores into the ocean floor and exhibiting drilling versatility. A further object is to provide a marine drilling apparatus of the type contemplated which is particularly adept at drilling directionally away from a working site.

DESCRIPTION OF THE DRAWINGS

FIG. 2 is a segmentary view in cross section of a portion of the view shown in FIG. 1.

FIG. 4 is a cross sectional view taken along line 4—4 of FIG. 2.

FIG. 5 is a segmentary view in cross section taken along line 5—5 of FIG. 2.

Figure 1:
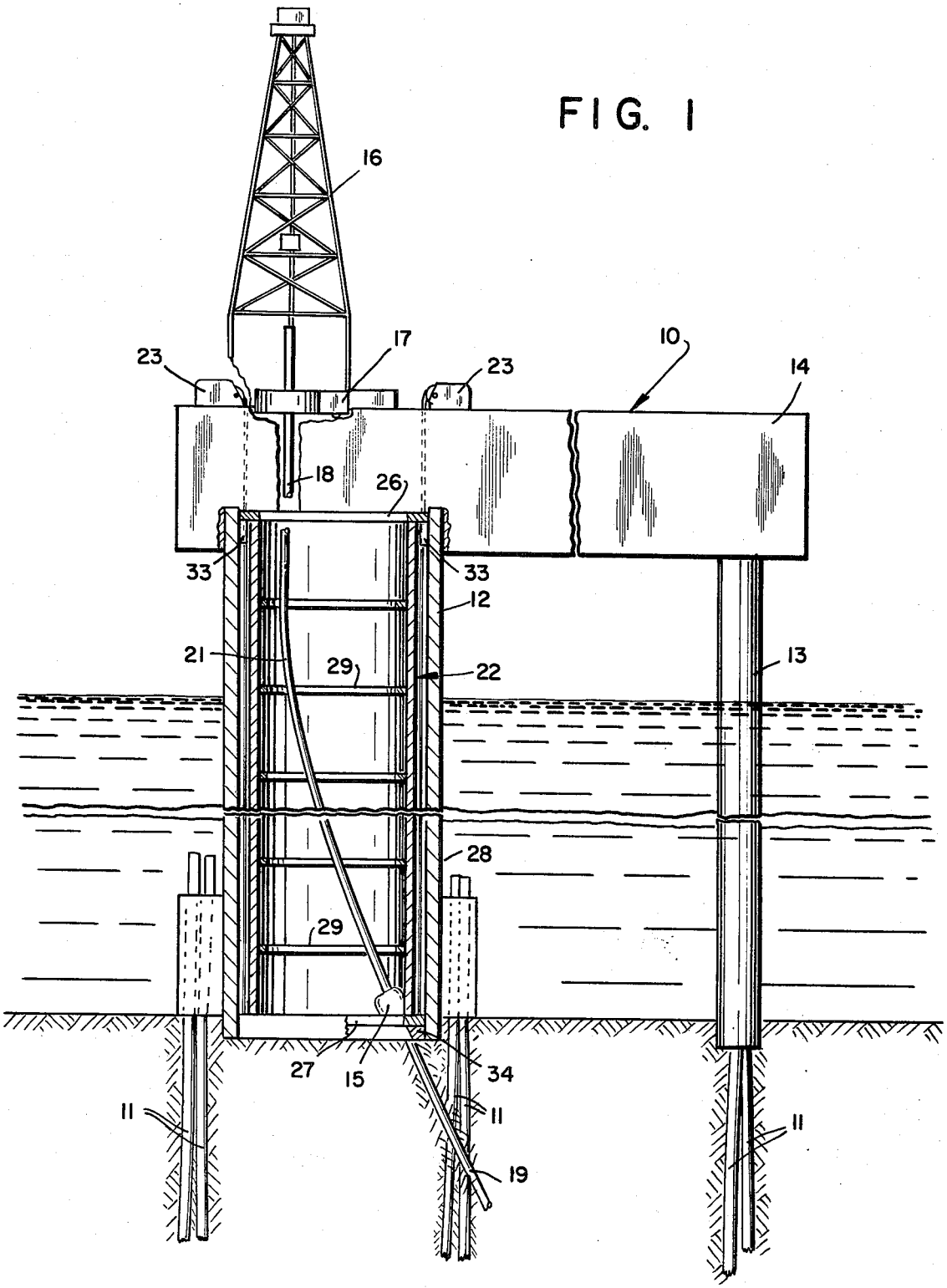
FIG. 1 is a vertical elevation view shown in partial cross section of a marine structure of the type contemplated.
Figure 3:
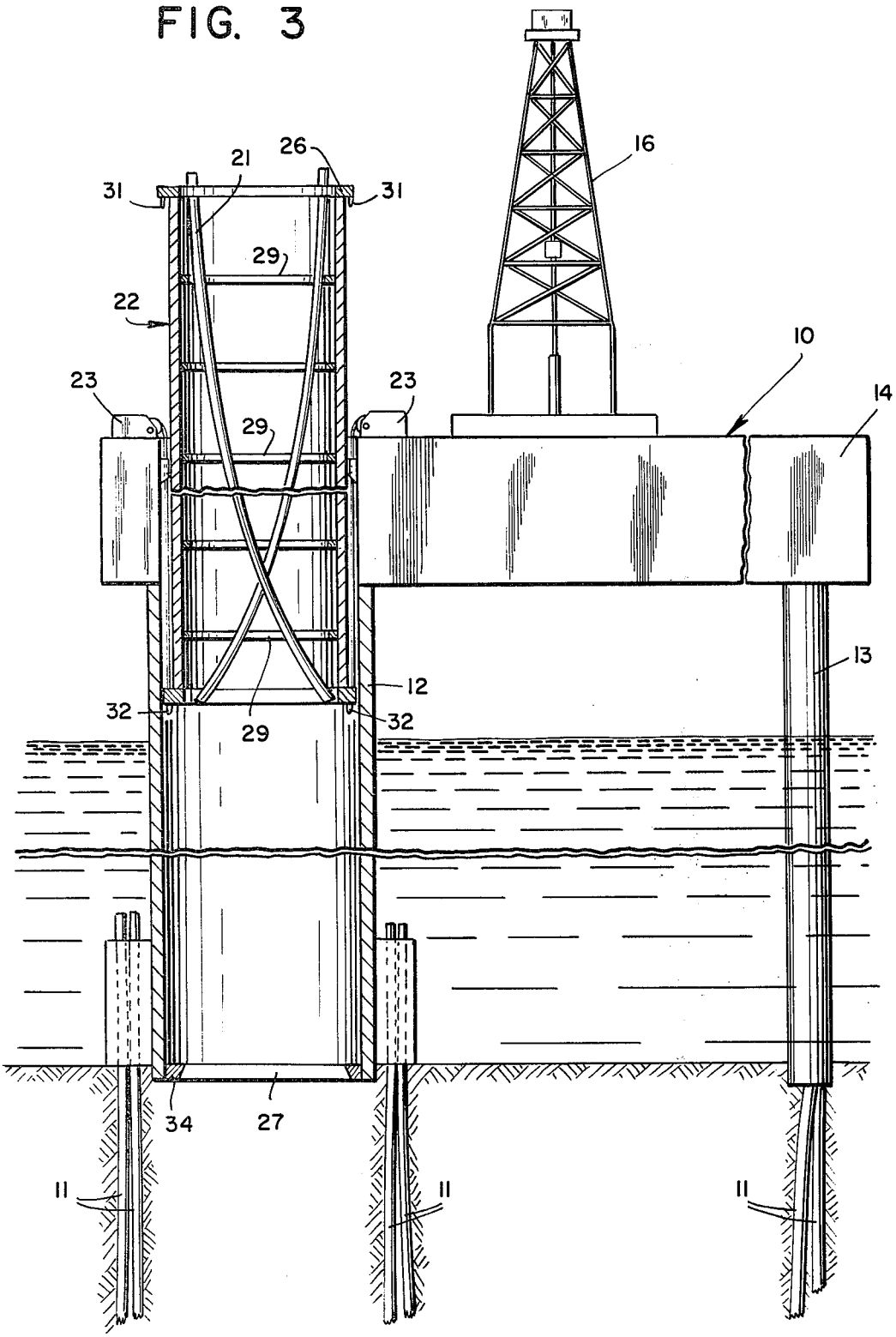
FIG. 3 is similar to FIG. 2 illustrating the conductor cage in the raised or removed position.

Referring to the drawings, a drilling structure 10 of the fixedly positioned type is shown, which structure utilizes the instant invention. Such an offshore structure or marine platform is normally barged or floated to a working site in a body of water and there controllably lowered into position. The latter is achieved by causing the structure to controllably sink into the water either by its own weight and buoyancy, or by being lowered from a fixed barge, vessel or the like.

With the structure in a resting position on the ocean floor, piles 11 are normally driven into the substrate through or about the various support legs 12 and 13 of the structure. A well head 15 is initially positioned at the ocean floor having means to engage the conductor 21 thereby providing a closed guide for the lowered drill string.

For drilling purposes, normally the structure's raised deck 14 is provided with a derrick 16, a rotary table 17, and similar ancillary equipment known in the industry for such an operation. Operationally, derrick 16 will support a drill string 18 through rotary table 17, in a generally vertical position. As the rotating string is lowered into the substrate it will commence its drilling operation in a vertical direction.

It is a known drilling technique to divert the drill from its original vertical disposition by various means. These can be provided or exercised by the driller to urge the drill a desired degree away from vertical, into a particular direction. In the present arrangement, the rotating drill head 19 is lowered into a conductor guide 21, thence through well head 15. Guide conductor 21 can be either curved or straight. In any event, as the rotating drill string 18 proceeds through guide 21, it will be urged or diverted into the desired direction.

In one embodiment of the invention a removable conductor cage 22 is suspended directly from the working deck 14 and beneath the rotary table. Said cage 22 is thus substantially submerged in the water at the drilling site even though the upper portion is exposed. However, because of waves, water currents, floating ice and the like, the exposed conductor or riser is often excessively stressed. Consequently it is enclosed within a protecting caisson or platform leg.

In one arrangement, and as shown in FIG. 1, cage 22 holding the respective conductor guides 21, is removably positioned longitudinally of, and within one of the support legs 12. Thus, even though structure 10 is provided with a plurality of, and usually at least four upstanding, substantially vertically positioned legs, any leg can be adapted to accommodate drilling cage 22.

Operationally, to fixedly position the platform, piles 11 are drilled external to the leg 12 and into the substrate. The number of piles utilized at any location will be a function of the consistency of the substrate, and the normal character of the weather at the particular offshore site. Further, said piles are inserted having in mind the wellbores which will be directed away from the legs.

Referring to FIG. 2, conductor cage 22 is shown supported within one of the platform's enlarged legs 12. Structurally, conductor cage 22 comprises upper and lower collars 26 and 27 respectively. These collars are fixedly spaced apart by a plurality of intermediate stringer members 28. A series of lateral braces 29 serve to further stiffen the cage.

With conductor cage 22 in place within support legs 12, it is preferably retained such that it can be released and rotatably adjusted as required within leg 12.

Conductor cage 22 is shown as supporting a single conductor 21. However, as a matter of practicality cage 22 can embody several such members. One or more of the conductors are usually inserted into cage 22 prior to installation of the platform or marine structure 10. Other conductors will subsequently be installed after the platform has been installed in its offshore position, depending on the drilling program. In the instance shown in FIGS. 1 and 2, the respective conductors 21 are curved and aligned with the upper, or drill entering end vertical. Thus, downwardly moving rotating drill string 18 will be urged in a direction determined by the disposition of conductor guide 21.

To drill a well in a particular direction away from the platform 10, the conductor 21 as shown is provided with a sufficient uniform curvature to deflect drill string 18 into the desired direction and angle with respect to the ocean without unduly stressing the string. The degree of curvature is generally such to permit free rotation of drill string 18 and yet accomplish the desired offsetting from the vertical disposition. As a rule of thumb the amount of offset is deemed to be approximately 6° for every 100 feet of vertical distance.

At such time as conductor guide 21 is properly aligned, rotating drill string 18 will be lowered by derrick 16 to enter the conductor upper end. The drill string will progress by its weight downwardly through the curved guide until it passes from the lower end.

In accordance with the usual drilling procedures, the conductor guide is fastened at its lower end to well head 15 to form in effect a closed conduit. Thus, drilling mud can be pumped and circulated through the drill string and returned through the conductor to provide the necessary lubrication and other necessary functions achieved by the mud.

At such time as the desired well has been completed, a determination will be made whether to drill further wells and in what direction. The drilled well is therefore capped or provided with flow control apparatus. If the initial well is found to have entered a producing reservoir, normally additional wells will be similarly drilled.

Thereafter, rather than installing another conductor guide 21 into the conductor cage 22 while the latter is submerged, the cage is disconnected from leg 12. After derrick 16 and rotary 17 have been temporarily displaced, the cage can be raised in its entirety from the water either with the aid of derrick 16, or through the use of a winching arrangement 23 on deck 14.

Normally the latter is such that it is equipped with cables that engage collar 27 at the cage lower end. The cage can then be lifted and withdrawn until its lower or submerged portion is above the water level. The cage can then be suspended in the exposed position or rested on deck 14. In its completely exposed position a new conductor or conductors can readily be inserted into the cage either by welding, bolting or other compatible means. Normally such additional conductors are welded in place and fixedly supported by the respective lateral members 29 within the conductor cage 22.

With the newly added conductor guide or guides firmly in place, the entire cage 22 is again lowered from its elevated position into its original position within leg 12. Prior to being fixed, however, the cage can be rotatably adjusted to align the conductor or conductors in a different alignment with respect to leg 12. This would permit either the original conductor guide 21 or the subsequently added guides to be properly directed to drill a new well or wells.

Referring to FIG. 2, positioning of cage 22 within leg 12 can be accomplished by any of several methods. Preferably, the cage is provided with a plurality of outstanding guide pins 31 and 32 about the upper and lower collars 26 and 27. Said pins are arranged to register within corresponding openings 35 formed in the upper and lower support rings 33 and 34. Thus, cage 22 can be rotatably indexed to any desired alignment prior to being lowered into seating engagement. When the latter occurs, pins 31 and 32 will register in openings 35 to firmly position the cage. The latter can then be rigidly held in operating position by bolting or pinning to the support rings 33 and 34. Thus, the cage will remain firm during a drilling operation.

Figure 6:
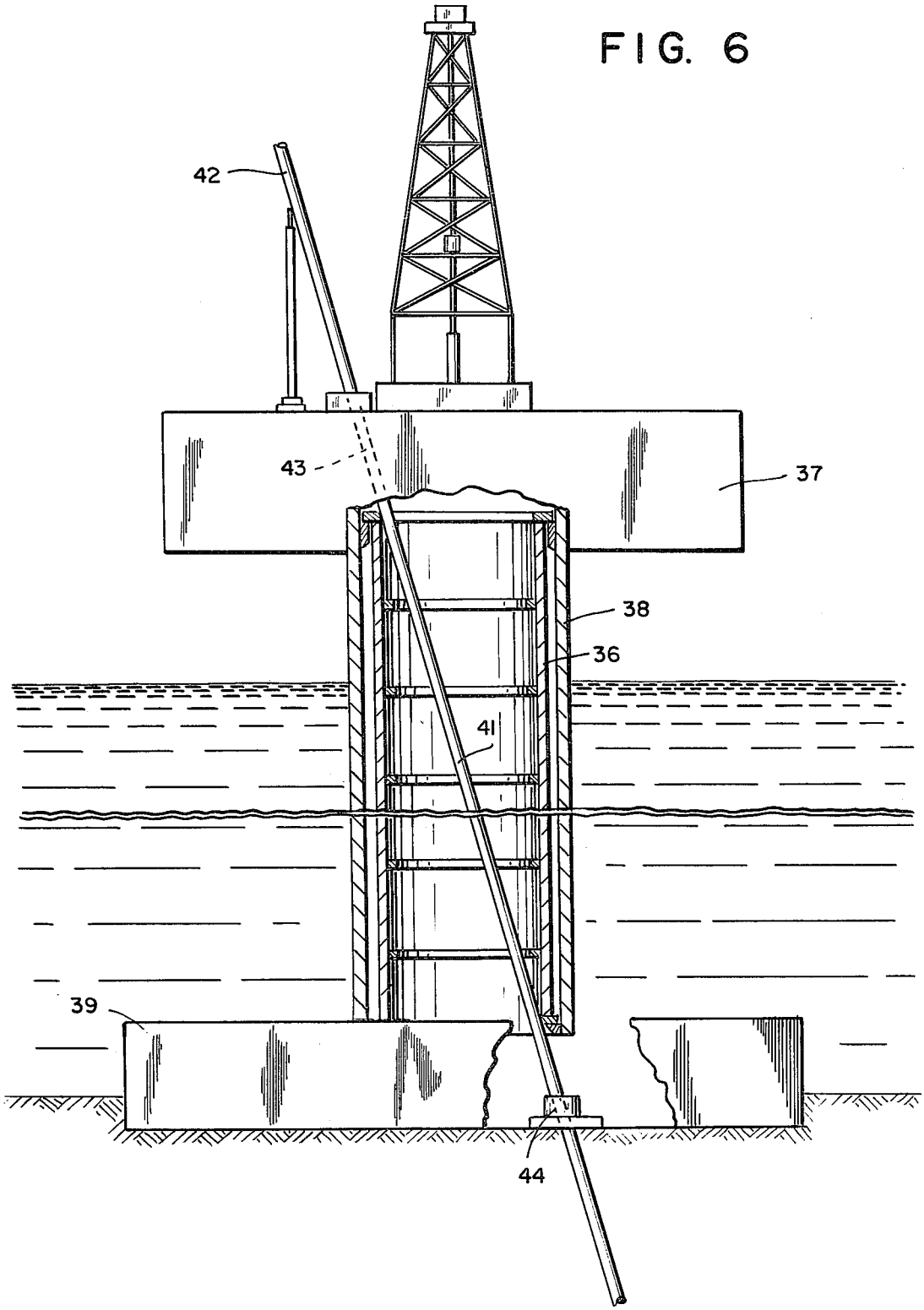
FIG. 6 is an elevational view in partial cross section of an alternate embodiment of the apparatus shown in FIG. 1.

Referring to FIG. 6, a conductor cage 36 is removably carried in a similar manner within a comparable offshore structure generally identified, due to its single support column, as a monopod unit. In the latter working deck 37 is supported a desired distance above the water's surface by a single, relatively large, elongated column 38. The latter in turn is positioned at its lower end in a submergible hull 39.

Operationally, after being floated to a working site, hull 39 is ballasted and caused to sink. The hull will eventually come to rest on a prepared section of the ocean floor. Working deck 37 is thereby positioned above the surface of the water a sufficient distance to facilitate a well drilling operation.

As noted herein, the drill string conductor guide can be either straight or preformed into a curved configuration. In the embodiment of FIG. 6, a straight conductor 41 is fastened in place within conductor cage 36 at a desired angle to the ocean floor.

To drill a well with this form of conductor 41, a slant drilling rig 42 is necessitated. In the latter, drill string 43 is initially supported at an angle and introduced into the conductor 41 inlet end.

Thereafter, drill string 43 is lowered through conductor 41, the lower end of which engages well head 44. The drill string can now enter the substrate at a substantial angle to the ocean floor and be further directed as required to reach a known or prospective reservoir.

As in the previous embodiment, cage 36 can be released from its fixed position and be raised upwardly through column 38. The latter is achieved by displacing the slant rig 42, as well as the rotary table, to one side, thus permitting cage 36 to pass through deck 37.

When so positioned, additional straight, or even curved conductors can be inserted into the cage. Thereafter the latter is again lowered into the column and fastened in anticipation of a drilling operation.

Other modifications and variations of the invention as hereinbefore set forth can be made without departing from the spirit and scope thereof, and therefore, only such limitations should be imposed as are indicated in the appended claims.

I claim:

1. A marine structure for drilling wells into the ocean floor at an offshore body of water, said structure including a deck (14) which is positioned above the water's surface, and is adapted to hold well drilling equipment including a rotatable drill string (19), at least one upstanding leg member (12) supportably connected to said deck (14) and extending downwardly to said ocean floor, a conductor cage (22) registered in and supportably positioned by said upstanding leg member (12) for a drilling operation, said cage being adapted to be disengaged from and removed from said leg member, at least one drill string conductor (21) depending from said conductor cage (22) defining a guide passage for registering said rotatable drill string (18), whereby to guide the latter as it is lowered from the deck toward the ocean floor, and means on said cage (22) for positioning additional drill string conductors thereto when said cage (22) is disengaged from, and removed from said upstanding leg (12).

2. In a marine structure as defined in claim 1, including connector means (31, 35) carried on said deck and said conductor cage respectively whereby to permit said cage to be rotatably indexed with respect to said leg.

3. In a marine structure as defined in claim 1, wherein said conductor cage 22 includes upper and lower spaced apart collars longitudinal, separating members engaging the respective collars, and mounting means for engaging additional conductors onto said cage.

4. In a marine structure as defined in claim 1, wherein said leg member includes an elongated cylindrical element having a longitudinal passage therethrough, said conductor cage being removably positioned within said longitudinal passage.

5. In a marine structure as defined in claim 1, wherein said upstanding leg member 12 includes guide means 35 depending from an inner wall thereof being aligned to guide said cage into operating position.

6. In a marine structure as defined in claim 1, wherein said upstanding leg member 12 includes an outer wall which defines a substantial enclosure about said cage 22 when the latter is in drilling position.

7. In a marine structure as defined in claim 2, wherein said connector means (31, 35) includes; a plurality of cages equispaced about said cage and leg respectively to permit rotational indexing of the cage within the leg.

8. In a marine structure as defined in claim 9, wherein said at least one drill string conductor (21) comprises; an elongated tubular member having a substantial uniform curvature along the length thereof.

9. In a marine structure as defined in claim 1, wherein said at least one drill string conductor (21) includes; an upper end thereof positioned in a substantially vertical disposition to receive a descending drill string.

* * * * *